US008009132B2

(12) United States Patent
Shin et al.

(10) Patent No.: US 8,009,132 B2
(45) Date of Patent: Aug. 30, 2011

(54) DISPLAY DEVICE AND DRIVING METHOD THEREOF

(75) Inventors: Byung-Hyuk Shin, Seoul (KR); Tae-Sung Kim, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 1149 days.

(21) Appl. No.: 11/508,648

(22) Filed: Aug. 22, 2006

(65) Prior Publication Data

US 2007/0046601 A1 Mar. 1, 2007

(30) Foreign Application Priority Data

Aug. 23, 2005 (KR) ..... 10-2005-0077447

(51) Int. Cl.
*G09G 3/36* (2006.01)

(52) U.S. Cl. ..... 345/89; 345/87; 345/88; 345/90; 345/92; 345/100; 345/101; 345/102; 345/103; 345/104; 345/694; 345/695

(58) Field of Classification Search ..... 345/87–104, 345/694–695

See application file for complete search history.

(56) References Cited

U.S. PATENT DOCUMENTS 5,436,747 A * 7/1995 Suzuki ..... 349/42
2003/0058229 A1* 3/2003 Kawabe et al. ..... 345/204
2004/0012554 A1* 1/2004 Song et al. ..... 345/92

FOREIGN PATENT DOCUMENTS

CN 1066139 A 11/1992

* cited by examiner

*Primary Examiner* — Richard Hjerpe
*Assistant Examiner* — Saifeldin Elnafia
(74) *Attorney, Agent, or Firm* — Innovation Counsel LLP

(57) ABSTRACT

A display device and a driving method thereof are disclosed. The display device includes a plurality of pixels arranged in a matrix with each pixel including first and second subpixels. First gate lines are connected to the first subpixel and transmit a first gate-on voltage, second gate lines are connected to the second subpixel and transmit a second gate-on voltage, and data lines are connected to the first and second subpixels and transmit first and second data voltages. The respective first and second data voltages that are applied to the first and second subpixels are obtained from the same image information, the first data voltage is not higher than the second data voltage, and the second data voltage is precharged in the data lines before applying the first data voltage to the first subpixel.

24 Claims, 11 Drawing Sheets

R
G
B
DE
Hsync
Vsync
MCLK
600
Signal Controller
SE
800
Gray Voltage Generator
DAT
CONT2
CONT1
500
Data Driver
300
D1
D2
D3
D4
D5
Dm-1
Dm
PX
G1a
G2a
Gna
G1b
G2b
Gnb
Voff
Von
400a
Gate Driver
400b
Gate Driver
Vcom

DISPLAY DEVICE AND DRIVING METHOD THEREOF

CROSS-REFERENCE TO RELATED APPLICATION

This application claims priority from and benefit of Korean Patent Application No. 10-2005-0077447 filed in the Korean Intellectual Property Office on Aug. 23, 2005, the entire content of which is incorporated herein by reference.

BACKGROUND OF THE INVENTION (a) Field of the Invention

The present invention relates to a display device and a driving method thereof.

(b) Description of Related Art

A liquid crystal display (LCD) includes two panels provided with pixel electrodes and a common electrode, and a liquid crystal (LC) layer with dielectric anisotropy disposed between the panels. The pixel electrodes are arranged in a matrix and are connected to switching elements such as thin film transistors (TFTs) such that they are supplied with data voltages row by row in a sequential manner. The common electrode covers an entire surface of one of the panels and is supplied with a common voltage. A pixel electrode and a common electrode as well as the LC layer interposed therebetween form an LC capacitor, and the LC capacitor and a switching element connected thereto are basic elements of a pixel.

The LCD applies voltages to the electrodes to form an electric field in the LC layer and adjusts the field strength to control the transmittance of light through the LC layer, thereby realizing desired images on the display. The LCD reverses the polarity of data voltages that are applied to the pixel electrodes with respect to the common voltage every frame, every row, or every dot to prevent the deterioration of the LC layer caused by long-term application of a unidirectional electric field.

In the meantime, since the LCD is a hold-type display, a blurring phenomenon that makes an image contour unclear can occur during the display of motion pictures. To eliminate the blurring phenomenon, an impulsive driving method that displays desired normal images while displaying a black image between them has been developed. However, the impulsive driving method has its disadvantages. For example, while the impulsive driving method displays normal images at intervals of N-th rows while displaying a black image between them, each N-th row has a different charging rate of a pixel row. As a result, a horizontal stripe may form in each N-th row.

SUMMARY OF THE INVENTION

Therefore, the motivation of the present invention is to provide a display device that can prevent deterioration of picture quality such as blurring, horizontal stripes, etc., and a driving method thereof.

In one aspect, the present invention is a display device that includes a plurality of pixels, a plurality of first gate lines, a plurality of second gate lines, and a plurality of data lines. The pixels are arranged in a matrix, and each pixel includes first and second subpixels. The first gate lines are connected to the first subpixel and transmit a first gate-on voltage, the second gate lines connected to the second subpixel and transmitting a second gate-on voltage; and the data lines connected to the first and second subpixels transmit first and second data voltages to the first and second subpixels. The two data voltages are obtained from the same image information, and the first data voltage is no lower than the second data voltage.

The display device may further comprise a data driver that applies an impulsive data voltage to the data lines before precharging the data lines with the second data voltage.

The data driver may precharge the second data voltage at least once every two horizontal periods.

The data driver may start the precharging of the second data voltage in a blank period of a horizontal period and applies the impulsive data voltage during the blank period.

The display device may further comprise a conductive material connecting the data lines to each other, wherein the impulsive data voltage is obtained by connecting the data lines to each other.

The data driver simultaneously may apply the first and second gate-on voltages to the first and second gate lines of multiple pixel rows when the impulsive data voltage is applied to the data lines.

The time for applying the first gate-on voltage and the time for applying the second gate-on voltage may at least partially overlap.

A time for applying the first gate-on voltage may be shorter than a time for applying the second gate-on voltage.

The display device may further comprise a gray voltage generator that generates first and second sets of gray voltages that are different from each other and a data driver selecting gray voltages corresponding to the image information from the first and second sets of gray voltages and applying the gray voltages to the first and second subpixels as the first and second data voltages.

The display device may further comprise a data driver that sequentially applies the first and second data voltages of a first M number of pixel rows to first and second subpixels of the first M number of pixel rows in an alternating manner, and simultaneously applies an impulsive data voltage to first and second subpixels of a second M number of pixel rows, M being a natural number.

The data driver may precharge the data lines with the second voltage after applying the impulsive data voltage to the first and second subpixels of the second M number of pixel rows.

The exemplary display device may further include: a gate driver connected to the first and second gate lines and applying the first and second gate-on voltages thereto; a data driver connected to the data lines and applying the first and second data voltages and the impulsive data voltage thereto; and a signal controller for controlling the data driver and the gate driver.

The data driver may start to precharge the second data voltage in the data lines within one horizontal period from the point of time when the impulsive data voltage is applied.

The signal controller transmits the pulse of a horizontal synchronization start signal to the data driver every horizontal period, but the pulse of the horizontal synchronization start signal may be omitted every predetermined number of horizontal periods.

The signal controller may omit the pulse of the horizontal synchronization start signal after changing the voltage level of a polarity signal.

The data driver may have a plurality of output terminals connected to the data lines, and it may connect the output terminals to each other in the horizontal period in which the pulse of the horizontal synchronization start signal may be omitted.

In another aspect, the invention is an exemplary driving method according to an embodiment of the present invention.

The method drives a display device that has first and second subpixels, a plurality of first and second gate lines respectively connected to the first and second subpixels, and a plurality of data lines connected to the first and second subpixels. The driving method includes: precharging the data lines with a first data voltage; applying a second data voltage to the second subpixel after the precharging of the data lines; and applying the first data voltage to the first subpixel after the application of the second data, wherein the first and second data voltages that are respectively applied to the first and second subpixels are obtained from the same image information, and the first data voltage is not lower than the second data voltage.

The exemplary driving method may further include applying an impulsive data voltage to the first and second subpixels before the charging of the data lines.

The applying of the impulsive data voltage may include connecting the data lines to each other.

The applying of the impulsive data voltage may include simultaneously applying the impulsive data voltage to the first and second subpixels of a plurality of pixel rows.

The applying of the first data voltage may include applying a first gate-on voltage to the first gate line and applying a gate-off voltage to the second gate line, and the applying of the second data voltage may include applying a second gate-on voltage to the second gate line and applying the first gate-on voltage to the first gate line.

The times for applying the first and second gate-on voltages in the application of the second data voltage may be overlapped at least partially.

The charging of the data lines may be carried out at least every two horizontal periods.

The exemplary method may further include: generating different first and second sets of gray voltages; selecting either the first set of gray voltages or the second set of gray voltages; and generating a first data voltage with reference to the first set of gray voltages when the first set of gray voltage is selected, and generating a second data voltage with reference to the second set of gray voltages when the second set of gray voltages is selected.

BRIEF DESCRIPTION OF THE DRAWINGS

The accompanying drawings briefly described below illustrate exemplary embodiments of the present invention, and, together with the description, serve to explain the principles of the present invention.

DETAILED DESCRIPTION OF EMBODIMENTS

Figure 1A:
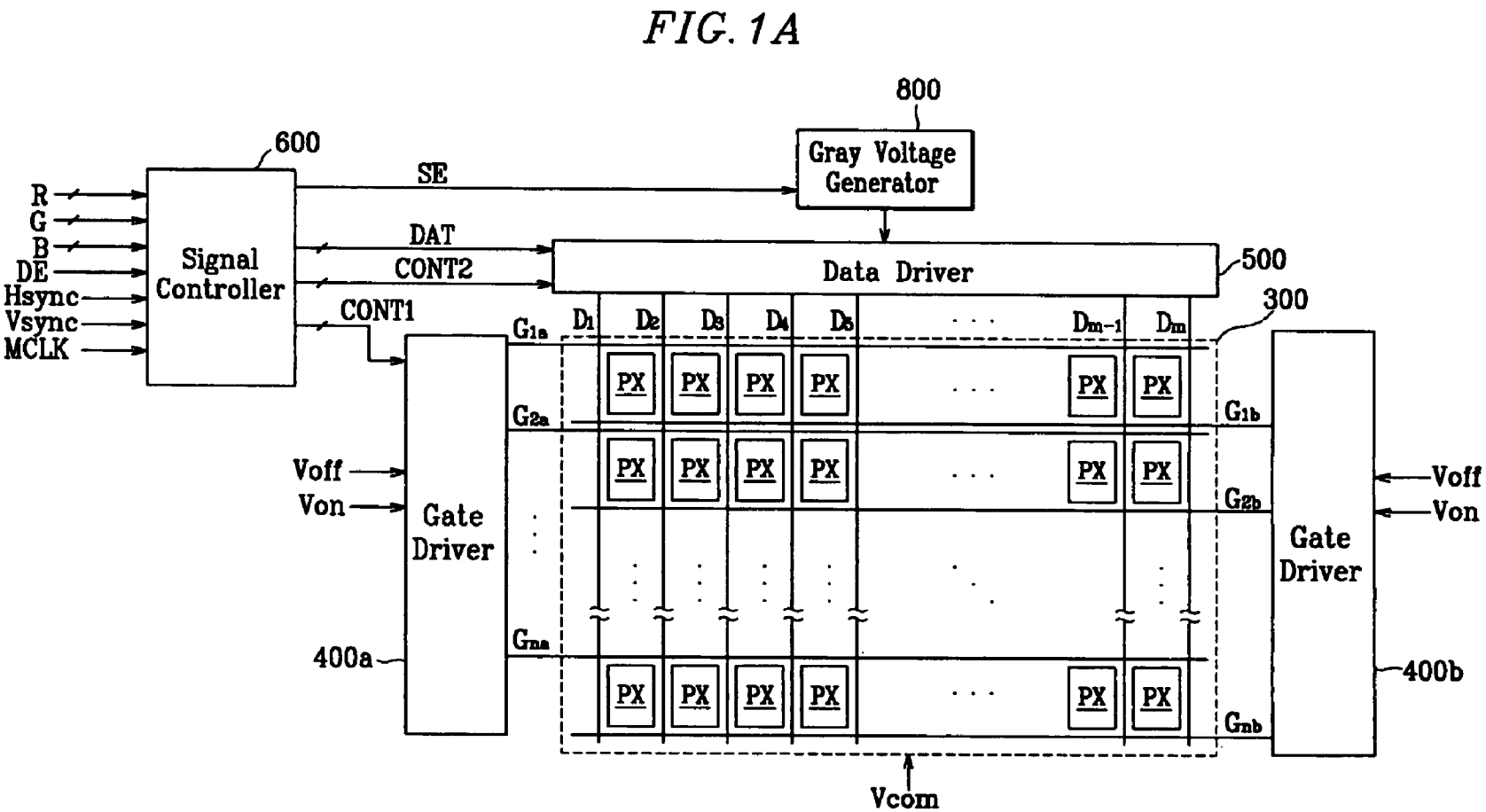
FIGS. 1A to FIG. 1C are block diagrams of a liquid crystal display device in accordance with an exemplary embodiment of the present invention.

With reference to the accompanying drawings, the present invention will be described in order for those skilled in the art to be able to implement the invention.

To clarify multiple layers and regions, the thicknesses of the layers are enlarged in the drawings. Like reference numerals designate like elements throughout the specification. When it is said that any part, such as a layer, film, area, or plate is positioned on another part, it means the part is directly on the other part or above the other part with at least one intermediate part. On the other hand, if any part is said to be mounted "directly" on another part it means that there is no intervening part between the two parts.

A liquid crystal display device in accordance with an exemplary embodiment of the present invention will be described below in detail with reference to the accompanying drawings.

Figure 1B:
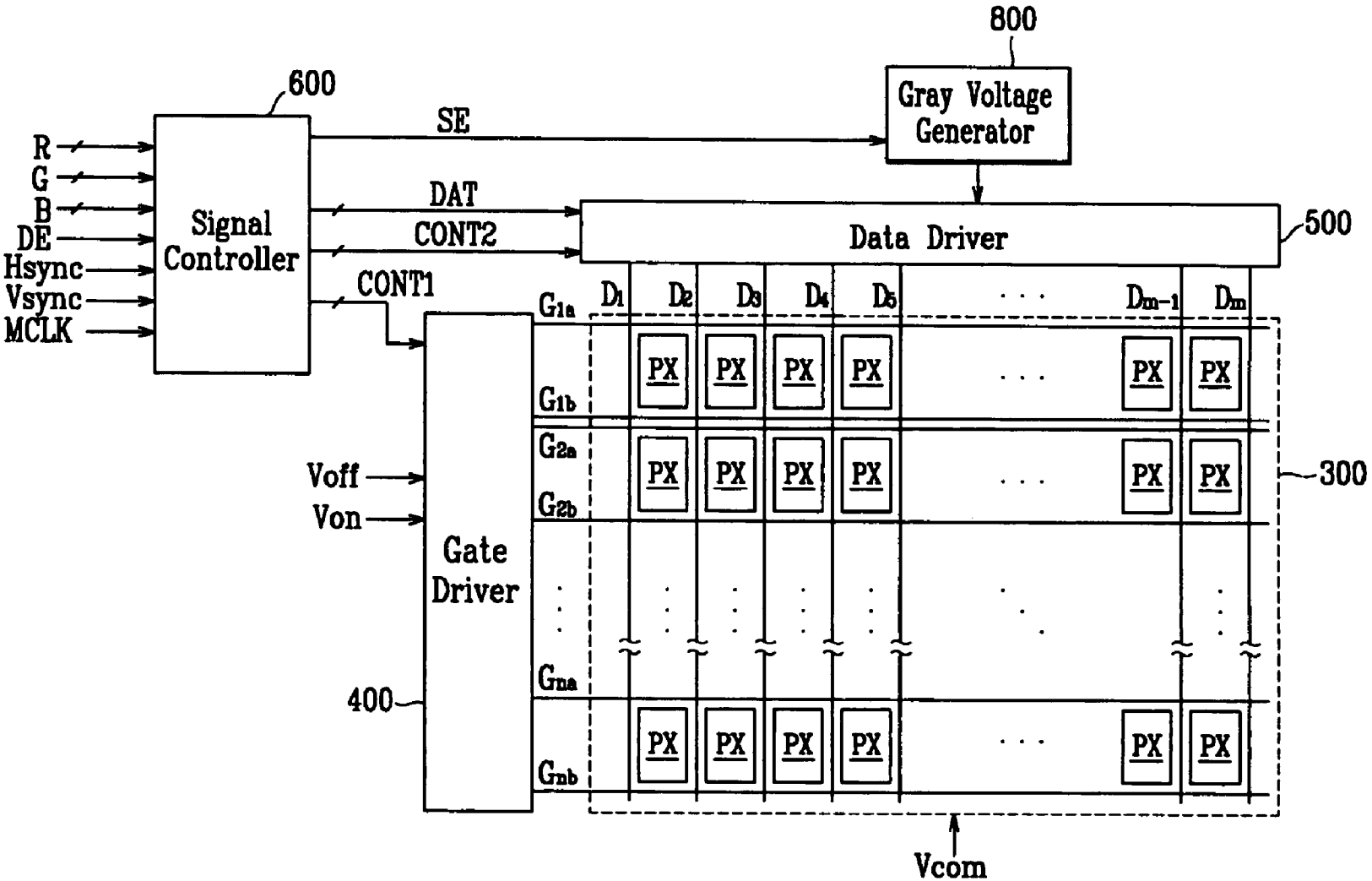
Figure 1C:
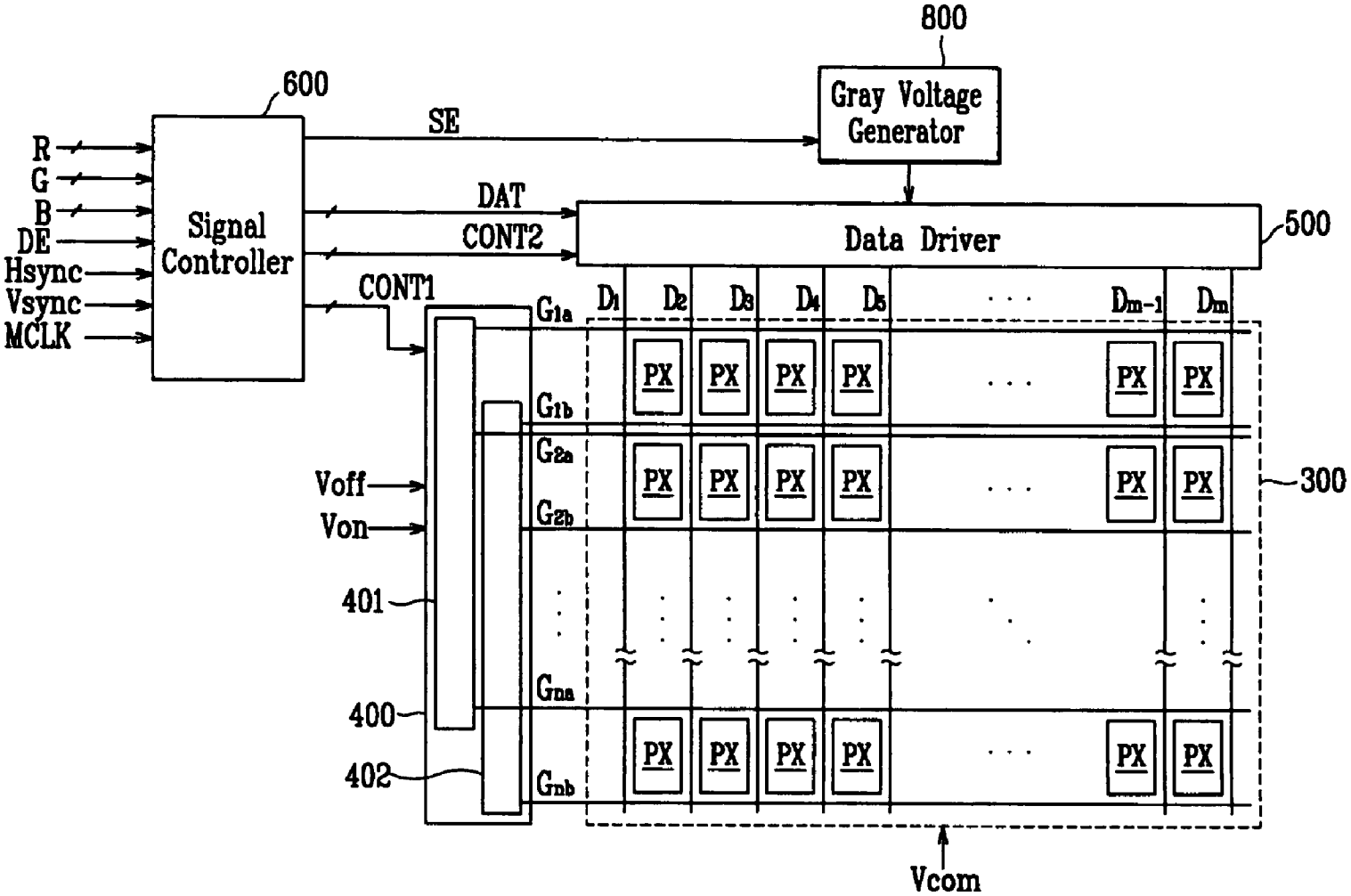
Figure 2:
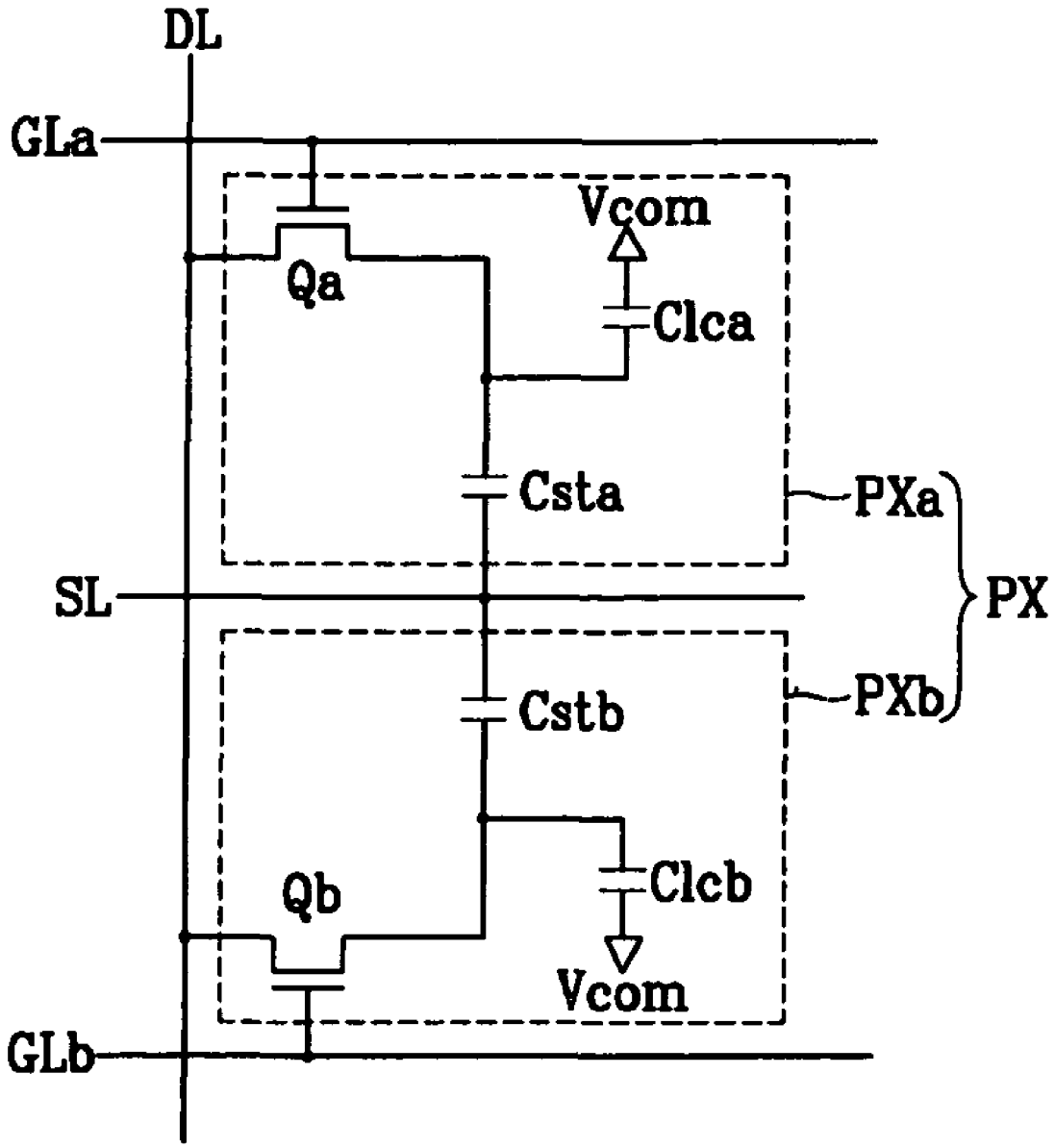
FIG. 2 is an equivalent circuit diagram for a pixel in the liquid crystal display device in accordance with the exemplary embodiment of FIGS. 1A to 1C.

FIGS. 1A to FIG. 1C are block diagrams of a liquid crystal display device in accordance with an exemplary embodiment of the present invention, FIG. 2 is an equivalent circuit diagram for a pixel in the Liquid crystal display device in accordance with the exemplary embodiment of FIGS. 1A to 1C, and FIG. 3 is an equivalent circuit diagram for a subpixel in the liquid crystal display device in accordance with the exemplary embodiment of FIGS. 1A to 1C.

Referring to FIG. 1A, a liquid crystal display device according to an embodiment of the present invention includes a liquid crystal panel assembly 300, a pair of gate drivers 400*a* and 400*b* and a data driver 500 that are connected to the panel assembly 300, a gray voltage generator 800 connected to the data driver 500, and a signal controller 600 controlling the above-described elements. The liquid crystal display device in FIG. 1B includes a gate driver 400 instead of two separate gate drivers 400*a* and 400*b*. The liquid crystal display device in FIG. 1C includes a gate driver 400 that has a first gate driving circuit 401 and a second gate driving circuit 402, the two portions driving different gate lines. These liquid crystal display devices will be described in more detail below.

Figure 3:
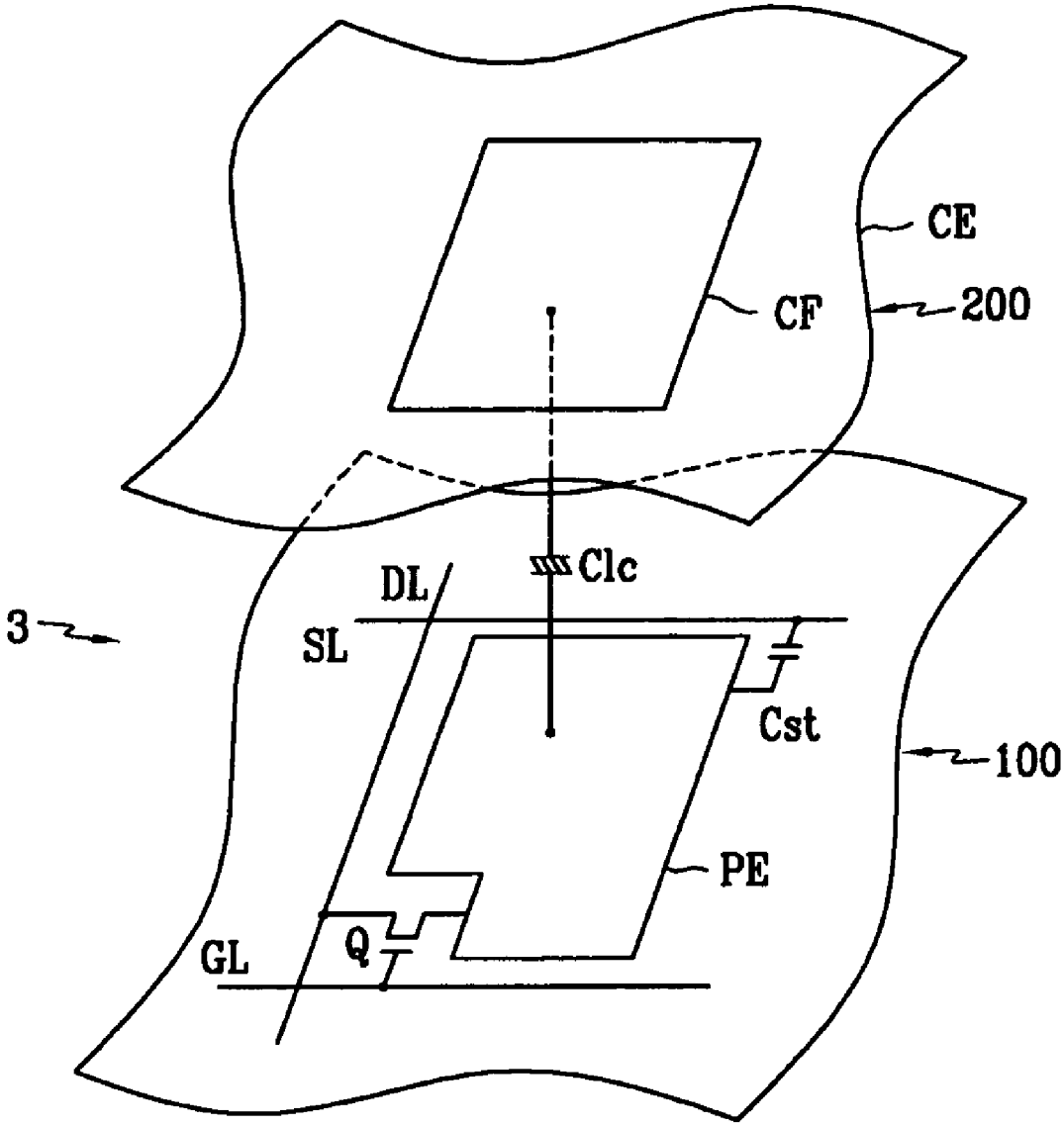
FIG. 3 is an equivalent circuit diagram for a subpixel in the liquid crystal display device in accordance with the exemplary embodiment of FIGS. 1A to 1C.

The liquid crystal panel assembly 300 includes a plurality of display signal lines $G_{1a}$-$G_{nb}$ and $D_1$-$D_m$ and a plurality of pixels PX connected to the display signal lines. The pixels PX are arranged approximately in a matrix configuration from an equivalent circuital view. On the other hand, the liquid crystal panel assembly 300 includes a lower panel 100 and an upper panel 200 that are positioned in parallel planes and a liquid crystal layer 3 interposed therebetween, as shown in FIG. 3.

The display signal lines $G_{1a}$-$G_{nb}$ and $D_1$-$D_m$ are provided on the lower panel 100 and include a plurality of gate lines $G_{1a}$-$G_{nb}$ for transmitting gate signals (also referred to as "scanning signals"), and a plurality of data lines $D_1$-$D_m$ for transmitting data signals (or data voltages). The gate lines $G_{1a}$-$G_{nb}$ extend substantially in a first direction and substantially parallel to each other, while the data lines $D_1$-$D_m$ extend substantially in a second direction and substantially parallel to each other. The first direction and the second direction are substantially perpendicular to each other.

FIG. 2 shows display signal lines and an equivalent circuit of a pixel PX. In addition to the gate lines denoted by reference numerals GLa and GLb and the data lines denoted by a reference numeral DL, the display signal lines further include storage electrode lines SL extending substantially parallel to the gate lines GLa and GLb.

Each pixel PX includes a pair of subpixels PXa and PXb. Each of the subpixels PXa/PXb includes a switching element Qa/Qb connected to the gate lines GLa/GLb and the data line DL, a liquid crystal capacitor Clca/Clcb connected thereto, and a storage capacitor Csta/Cstb that is connected to the switching element Qa/Qb and the storage electrode lines SL.

Referring to FIG. 3, the switching element Q of each of the subpixels PXa and PXb has three terminals of a thin film transistor provided on the lower panel 100, and the three terminals are a control terminal connected to one of the gate lines GL, an input terminal connected to one of the data lines DL, and an output terminal connected to both the LC capacitor Clc and the storage capacitor Cst.

The LC capacitor Clc includes a subpixel electrode PE provided on the lower panel 100 and a common electrode CE provided on the upper panel 200 as two terminals. The LC layer 3 disposed between the two electrodes PE and CE functions as a dielectric of the LC capacitor Clc. The subpixel electrode PE is connected to the switching element Q. The common electrode CE covers an entire surface of the upper panel 200 and is supplied with a common voltage Vcom. Unlike FIG. 3, the common electrode CE may be provided on the lower panel 100, and at least one of the two electrodes PE and CE may have a line shape or a bar shape. The LC layer 3 has negative dielectric anisotropy, and the LC molecules in the LC layer 3 are aligned such that their long axes are vertical or horizontal to the surfaces of the two panels in the absence of an electric field. Hereinafter, a subpixel electrode of the subpixel PXa is denoted by PEa, and a subpixel electrode of the subpixel PXb is denoted by PEb.

The storage capacitor Cst serving as a subsidiary for the LC capacitor Clc is defined by the overlap of the storage electrode lines SL and the subpixel electrode PE provided on the lower panel 100 with an insulator formed between them. The storage electrode lines SL are supplied with a predetermined voltage such as the common voltage Vcom. Alternatively, the storage capacitor Cst is defined by the overlap of the subpixel electrode PE and its previous gate line with an insulator between them.

For color display, each pixel (PX) uniquely represents one of primary colors (i.e., spatial division) or each pixel (PX) sequentially represents the primary colors in turn (i.e., temporal division) such that a spatial or temporal sum of the primary colors is recognized as a desired color. A typical example of primary colors includes red, green, and blue. FIG. 3 shows the case of spatial division in which each pixel PX includes a color filter CF representing one of the primary colors in an area of the upper panel 200 corresponding to the subpixel electrodes PEa and PEb. Unlike in FIG. 3 the color filter CF may be provided on or under the subpixel electrode PEa and PEb on the lower panel 100.

At least one polarizer (not shown) for polarizing the light is coupled to the outer side of the liquid crystal panel assembly 300. The polarizing axes of the two polarizers may cross each other. One of the polarizers may be omitted when the LCD is a reflective LCD. In the case of crossed polarizers, incident light coming into the LC layer 3 having no electric field is blocked.

Referring to FIGS. 1*a* to 1*c*, the gate drivers 400*a* and 400*b*, or 400, are connected to the gate lines $G_{1a}$-$G_{nb}$ and apply gate signals received from an external device to the gate lines $G_{1a}$-$G_{nb}$, each gate signal being a combination of a gate-on voltage Von and a gate-off voltage Voff. In FIG. 1A, the pair of gate drivers 400*a* and 400*b* is disposed at the left and right sides of the liquid crystal panel assembly 300 and each is connected to a subgroup of the gate lines such that all the gate lines $G_{1a}$-$G_{nb}$ are connected to one of the gate drivers 400*a*, 400*b*. The gate driver 400 as shown in FIG. 1B and FIG. 1C is disposed at one side of the liquid crystal panel assembly 300 and is connected to every gate line $G_{1a}$-$G_{nb}$. In FIG. 1C, two driving circuits 401 and 402 are embedded in the gate driver 400, and they are each connected to a subgroup of the gate line $G_{1a}$-$G_{nb}$. For example, the two driving circuits 401, 402 may be connected to odd numbered and even numbered gate lines $G_{1a}$-$G_{nb}$, respectively.

The gray voltage generator 800 generates two sets of a plurality of gray voltages (or reference gray voltages) related to the transmittance of the pixels PX. The two sets of (reference) gray voltages are independently provided to two subpixels PXa and PXb constituting one pixel PX, and are generated based on different gamma curves. The gray voltages in one set have a positive polarity with respect to the common voltage Vcom, while those in the other set have a negative polarity with respect to the common voltage Vcom. Alternatively, in place of the two sets of (reference) gray voltages, one set of (reference) gray voltages may be generated. The gray voltage generator 800 includes an analog switch (not shown) for selecting and outputting one of the two sets of (reference) gray voltages according to a selection signal SE. Depending on the embodiment, the analog switch may be integrated in the liquid crystal panel assembly 300 or integrated in the data driver 500.

A voltage amplitude of one of the two sets of (reference) gray voltages is smaller than that of the other, and the smaller one corresponds to the subpixel electrode PEb while the larger one corresponds to the subpixel electrode PEa. If the selection signal SE is of a low level, the gray voltage generator 800 outputs a set of (reference) gray voltages for a subpixel PXb, while if the selection signal SE is of a high level, it outputs a set of (reference) gray voltages for a subpixel PXa.

The data driver 500 is connected to the data lines $D_1$-$D_m$ of the liquid crystal panel assembly 300 and applies a gray voltage selected from the set of gray voltages supplied to the data lines $D_1$-$D_m$ by the gray voltage generator 800. Alternatively, the data driver 500 selects one out of the two sets of gray voltages supplied from the gray voltage generator 800 and applies the selected gray voltage to the data lines $D_1$-$D_m$ as a data signal. However, in a case where the gray voltage generator 800 does not provide respective voltages for every gray scale but rather provides only a predetermined number of reference gray voltages, the data driver 500 divides the reference gray voltage to generate gray voltages for the entire gray scale and selects a data signal from the generated gray voltages.

The signal controller 600 controls the gate driver 400, the data driver 500, the gray voltage generator 800, etc.

Each of the drivers 400*a*, 400*b*, 400, 500, 600, and 800 may be directly mounted as at least one integrated circuit (IC) chip. The drivers 400*a*, 400*b*, 400, 500, 600, and 800 may be mounted on the panel assembly 300 or on a flexible printed circuit film (not shown) in a tape carrier package (TCP) type, which are attached to the LC panel assembly 300. Alternatively, the drivers 400*a*, 400*b*, 400, 500, 600, and 800 may be mounted on a separated printed circuit board (not shown). As yet another alternative, the drivers, 400*a*, 400*b*, 400, 500, 600, and 800 may be integrated with the panel assembly 300 in the form of a plurality of driving circuits. Further, the drivers 400*a*, 400*b*, 400, 500, 600, and 800 may be integrated as a single chip. In this case, at least one of them or at least one circuit device constituting them may be located outside of the single chip.

Now, the operation of the above-described LCD will be described in detail.

The signal controller 600 is supplied with input image signals R, G, and B and input control signals for controlling the display thereof from an external graphics controller (not shown). The input image signals R, G, and B contain luminance information of each pixel PX, and the luminance has a predetermined number of gray scales, such as 1024 ($=2^{10}$), 256 ($=2^8$) or 64 ($=2^6$) gray scales. The input control signals include, for example, a vertical synchronization signal Vsync, a horizontal synchronization signal Hsync, a main clock signal MCLK, and a data enable signal DE.

After generating gate control signals CONT1, data control signals CONT2, and selection signals SE and processing the image signals R, G, and B to be suitable for the operation of the panel assembly 300 and the data driver 500 on the basis of the input control signals and the input image signals R, G, and B, the signal controller 600 provides the gate control signals CONT1 for the gate driver 400, the processed image signals DAT and the data control signals CONT2 for the data driver 500, and the selection signals SE for the gray voltage generator 800. Output image signals DAT are digital signals that have a predetermined number of values (or gray scales), and they include normal image data that is generated depending on the input image signals R, G, and B and impulsive data for impulsive driving. A gray scale value of the impulsive data is smaller than a gray scale value of normal image data of a corresponding pixel PX. In some cases, the impulsive data may have a constant gray scale. The constant gray scale may be the lowest gray scale or black or a gray scale of a predetermined level representing a luminance within a predetermined range.

The gate control signals CONT1 include a scanning start signal STV for instructing to start scanning, at least one clock signal for controlling the output time of the gate-on voltage Von, and at least one output enable signal OE for defining the duration of the gate-on voltage Von.

The data control signals CONT2 include a horizontal synchronization start signal STH for informing the start of transmission of output image signals DAT of one pixel row, a load signal LOAD for instructing to apply the data signals to the liquid crystal panel assembly 300, and a data clock signal HCLK. The data control signals CONT2 further include a polarity signal POL for reversing the polarity of the voltages of the data signals with respect to the common voltage Vcom (hereinafter, the polarity of the voltages of the data signals with respect to the common voltage is referred to as "the polarity of the data signals").

The signal controller 600 converts an M number of sets of input image signals R, G, and B into an M number of sets of normal image data, and generates a set of impulsive data. The time for inputting the M number of sets of input image signal R, G, and B and the time for outputting an (M+1) number of sets of output image signal DAT are substantially the same (M is a natural number). Accordingly, the frequency of the horizontal synchronization start signal STH is (M+1)/M times greater than that of a horizontal synchronization signal Hsync. The frequency of the data clock signal HCLK that is synchronized with the output image signal DAT may be (M+1)/M times greater than that of the main clock signal MCLK that is synchronized with the input image signals R, G, and B.

Responsive to the data control signals CONT2 from the signal controller 600, the data driver 500 receives output image signals DAT for a row of pixels from the signal controller 600, converts the output image signals DAT into analog data voltages by selecting gray voltages corresponding to the respective digital image signals DAT, and applies the digital image signals DAT to the data lines.

The data driver 500 is described in more detail with reference to FIG. 4.

Figure 4:
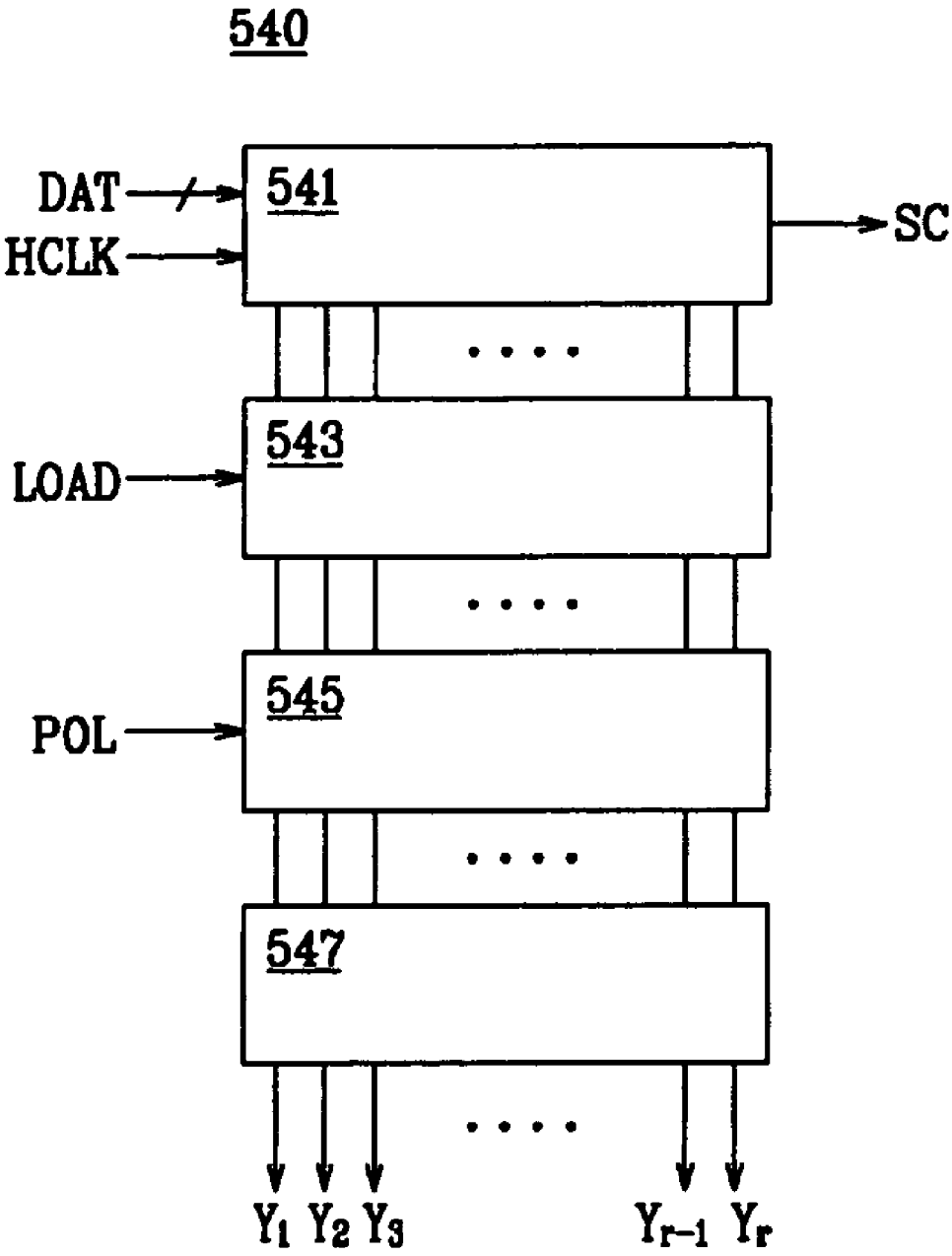
FIG. 4 is a block diagram illustrating an example of a data driver of the liquid crystal display device as shown in FIGS. 1A to 1C.

FIG. 4 is a block diagram illustrating an example of a data driver of the liquid crystal display device as shown in FIGS. 1A to 1C.

The data driver 500 includes at least one data driving IC 540 as shown in FIG. 4. The data driving IC 540 includes a shift register 541, a latch 543, a digital to analog converter 545 and a buffer 547 that are sequentially connected.

The shift register 541 sequentially shifts image data DAT that is input according to a data clock signal HCLK to transmit it to the latch 543 when it is supplied with a horizontal synchronization start signal STH. In a case where the data driver 500 includes a plurality of data driving ICs 540, the shift register 541 shifts all of the image data that the shift register 541 controls, and thereafter outputs a shift clock signal SC to the shift register of a neighboring data driving IC.

The latch 543 includes first and second latches (not shown). The first latch receives image data DAT sequentially from the shift register 541 and stores them, while the second latch receives image data DAT simultaneously from the first latch according to a load signal LOAD and outputs them to the digital to analog converter 545.

The digital to analog converter 545 converts the digital image data DAT from the latch 543 into analog data voltages and outputs them to the buffer 547. The data voltages have a positive value or a negative value with respect to a common voltage Vcom according to a polarity signal POL.

The buffer 547 outputs the data voltages received from the digital to analog converter 545 via output terminals $Y_1$-$Y_r$. The polarities of the data voltages output via the neighboring output terminals $Y_1$-$Y_r$ are different from each other. The output terminals $Y_1$-$Y_r$ are connected to data lines $D_1$-$D_m$.

The gate driver 400 applies the gate-on voltage Von to the gate lines in response to the gate control signals CONT1 from the signal controller 600, thereby turning on the switching elements Q connected thereto. The data signals applied to the data lines are supplied to the corresponding subpixels PXa and PXb through the turned-on switching elements Q.

The pair of subpixel electrodes PEa and PEb included in one pixel PX are supplied with different data voltages via the same data line at different times. The area of the subpixel electrode PEa is less than the area of the subpixel electrode PEb, and the voltage of the subpixel electrode PEa is higher than the voltage of the subpixel electrode PEb.

If a potential difference is generated between both ends of the liquid crystal capacitors Clca and Clcb, an electric field that is substantially perpendicular to the surfaces of the panels 100 and 200 is generated in the liquid crystal layer 3. The LC molecules in the liquid layer 3 are tilted such that their long axes are vertical to the direction of the electric field. The degree of change in polarization of incident light on the liquid crystal layer 3 depends on the degree of tilting of the liquid crystal molecules. Such a change in polarization is expressed as a change in transmittance by a polarizer. By this change, the liquid crystal display device displays images.

The degree of tilting of the liquid crystal molecules depends on the intensity of the electric field. Since the voltages of the two liquid crystal capacitors Clca and Clcb are different from each other, the tilt angles of the liquid crystal molecules in the two subpixels PXa, PXb become different, and accordingly the luminance of the two subpixels PXa and PXb become different. Hence, by properly adjusting the voltage of the liquid crystal capacitor Clca and the voltage of the liquid crystal capacitor Clcb, the image viewed from the side can be made as close to the image viewed from the front as possible. That is, a side gamma curve can be made as close to a front gamma curve as possible, thereby improving lateral visibility.

Moreover, by making the area of the subpixel electrode PEa supplied with a high voltage smaller than the area of the subpixel electrode PEb, the side gamma curve can be made closer to the front gamma curve. In particular, if the ratio of the areas of the subpixel electrode PEa and PEb is set to approximately 1:2, the side gamma curve is made to be much closer to the front gamma curve, thereby making lateral visibility much better.

By repeating this procedure by a unit of the horizontal period (which is denoted by "1H" and is equal to one period of the horizontal synchronization signal STH), all subpixels PXa and PXb are supplied with a data voltage, thereby displaying a normal image of one frame and an impulsive image.

The liquid crystal display device sequentially displays the pixel rows of the normal image one by one from a first pixel row to the last, displays the normal image on an M number of pixel rows, and displays the impulsive image simultaneously on the M number of pixel rows within the period 1H starting from the k-th pixel row. If this procedure is repeated for one frame, it looks as if an impulsive image band having the width of the k number of pixel rows rotates. If desired, the normal image and impulsive image may be displayed in an opposite direction starting from the last row.

When the next frame starts after finishing one frame, the polarity signal POL applied to the data driver 500 is controlled such that the polarity of the data voltages applied to each of the subpixels PXa and PXb is reversed from the polarity of the previous frame. The state of the polarity signal POL applied to the data driver 500 is controlled according to a polarity inversion method including row inversion, dot inversion, column inversion, etc.

Next, a driving method of a liquid crystal display device according to the exemplary embodiment of the present invention will be described with reference to FIGS. 5 to 7.

Figure 5:
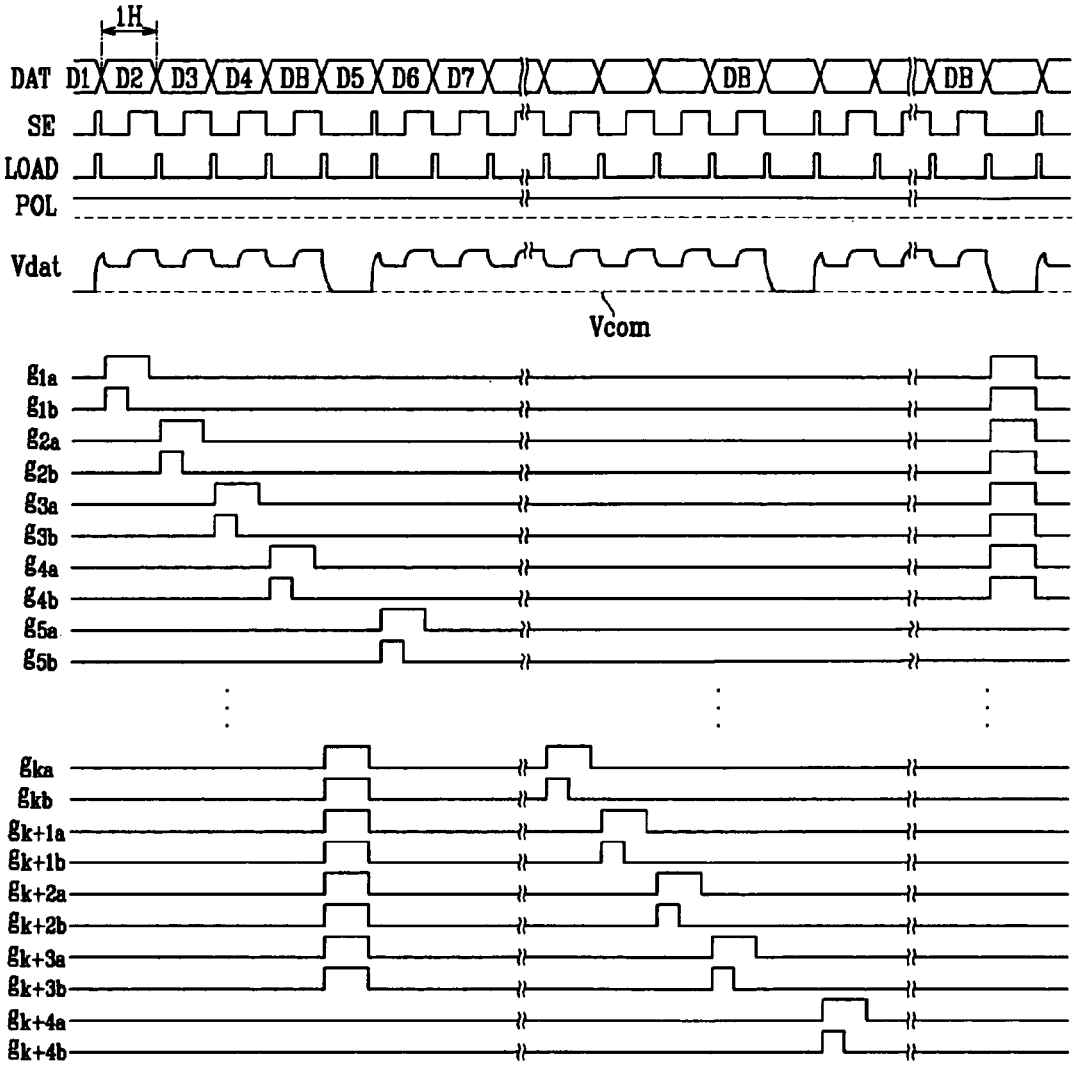
FIG. 5 is a timing diagram illustrating a driving signal of the liquid crystal display device in accordance with the exemplary embodiment of FIGS. 1A to 1C.
Figure 6:
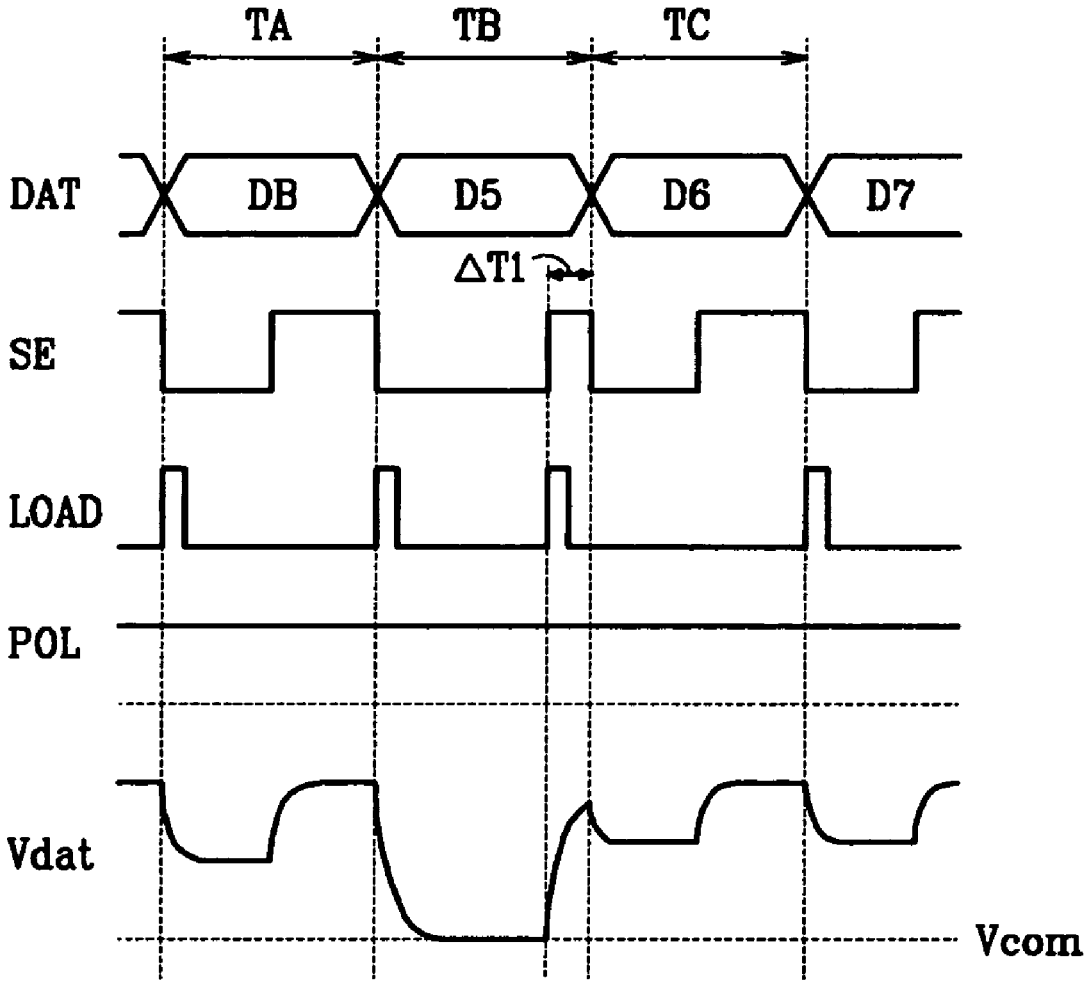
FIG. 6 is an expanded timing diagram illustrating part of the timing diagram of FIG. 5.
Figure 7:
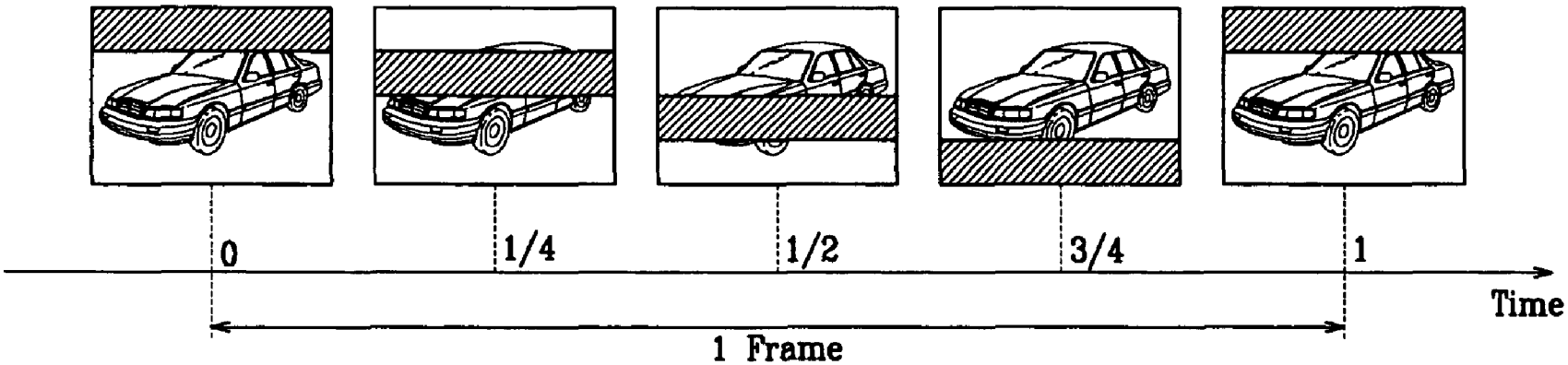
FIG. 7 is a schematic diagram illustrating an image displayed according to the driving signal as shown in FIG. 5 for one frame.

FIG. 5 is a timing diagram illustrating a driving signal of the liquid crystal display device in accordance with the exemplary embodiment of the present invention, FIG. 6 is an expanded timing diagram illustrating a part of the timing diagram of FIG. 5, and FIG. 7 is a schematic diagram illustrating an image displayed according to the driving signal as shown in FIG. 5 for one frame.

In this embodiment, M is 4. That is, the signal controller 600 converts four sets of input image signals R, G, and B into four sets of normal image data and generates a set of impulsive data DB, Thus, with respect to four pixel rows, the normal image data is sequentially displayed, and the impulsive data is displayed once.

First, the signal controller 600 provides normal image data D1 for pixels PX of a first row to the data driver 500. The data driver 500 receives the normal image data D1 sequentially via the shift register 541 and stores them in the latch 543. The signal controller 600 changes a load signal LOAD to a high level when the transmission of the normal image data D1 is finished, and accordingly the data driver 600 applies data voltages for the normal image data D1 to the corresponding data lines. The signal controller 600 changes a selection signal SE to a low level so that the data driver 500 generates a data voltage for a subpixel PXb with reference to a set of (reference) gray voltages for a subpixel PXb.

Meanwhile, as shown in FIGS. 5 and 6, even if the data driver 500 applies the data voltage to the data lines $D_1$-$D_m$, the data line voltage Vdat to be charged in the data lines $D_1$-$D_m$ is different from the data voltage due to an RC delay of the data lines $D_1$-$D_m$ immediately after the data voltage is applied.

Therefore, after the passage of an appropriate period of time during which the data line voltage becomes close to the data voltage, the gate driver 400 applies the gate-on voltage Von to the gate lines $G_{1a}$ and $G_{1b}$, thereby turning on the switching elements Q connected thereto. Then, the data voltage for the subpixel PXb is applied to the corresponding subpixel electrodes PEa and PEb. Alternatively, the gate-on voltage Von may be applied during the period of time in which the selection signal SE changes from a high level to a low level, or the gate-on voltage Von may be applied between the above two periods of time.

After a predetermined period of time, the signal controller 600 sets the selection signal SE to a high level, and thus the data driver 600 generates a data voltage for a subpixel PX with reference to the set of (reference) gray voltages for a subpixel PXa and then applies it to the appropriate data line. At the same time, the gate driver 400 applies a gate-off voltage Voff to the gate line $G_{1b}$. However, the gate driver 400 maintains the gate-on voltage applied to the gate line $G_{1a}$. Then, the switching element Qb is kept turned on, and the data voltage for the subpixel Pxa is applied to the corresponding subpixel electrode PEa.

By overlapping the gate-on voltage Von applied to the subpixel PXa with the gate-on voltage Von applied to the subpixel PXb, the charging rate of the subpixel PXa can be increased. The point of time when the gate-on voltage Von is applied to the subpixel PXa does not have to match the point of time when the gate-on voltage Von is applied to the subpixel PXb.

By first charging the subpixel PXb with a low data voltage before charging the the subpixel PXa with a high data voltage, the charging time can be reduced as compared to charging in reverse.

The signal controller 600, the data driver 500 and the gate driver 400 repeat the above-described operations with respect to pixels PX of the second to fourth rows.

The signal controller 600 performs column inversion driving by inverting the polarity signal POL between a high level and a low level frame by frame in an alternating manner. Accordingly, the polarity of the data voltage flowing through one data line is the same. However, the present invention is not limited thereto, and row inversion and dot inversion driving are also contemplated.

As shown in FIG. 6, in a segment TA, the signal controller 600 outputs impulsive data DB to the data driver 600 during the charging of a data voltage in the pixels PX of the fourth row. When the transmission of the impulsive data DB is completed, in a segment TB, the signal controller 600 changes the load signal LOAD to a high level, and accordingly the data driver 600 applies the data voltage for the impulsive data DB to the corresponding data line. The data voltage for the impulsive data DB may be equal to the common voltage Vcom. At this time, though the selection signal SE is at a low level, it may also be at a high level.

The gate driver 400 simultaneously applies the gate-on voltage Von to the gate lines $G_{ka}$-$G_{k+3b}$ of the k-th to (k+3)-th pixel rows, thereby turning on the switching elements Qa and Qb connected thereto. Then, the data voltage for the impulsive data DB is applied to the corresponding subpixel electrodes PEa and PEb to display an impulsive image.

In a segment TB, the signal controller 600 outputs a normal image data D5 to the data driver 500 for the pixels PX of the fifth row. Meanwhile, one horizontal period is divided into a data transmission period and a blank period. During the data transmission period, image data for the pixels PX of one row are actually transmitted. The blank period is the period between the completion of transmission and the transmission of image data for pixels PX of the next row. In the blank period of the segment TB, the signal controller 600 again changes the load signal LOAD to a high level, and changes the selection signal SE to a high level. Accordingly, the data driver 500 generates a data voltage for the normal image data D5 with reference to the set of (reference) gray voltages for a subpixel PXa and applies it to the appropriate data line. However, if the selection signal SE is maintained at a high level in the data transmission period of the segment TB, the signal controller 600 causes the selection signal SE to continually maintain a high level even in the blank period of the segment TB.

When a segment TC is started, the signal controller 600 changes the selection signal SE to a low level. Accordingly, the data driver 500 generates a data voltage for the normal image data D6 with reference to the set of (reference) gray voltages for a subpixel PXb and then applies it to the appropriate data line. The gate driver 400 applies the gate-on voltage Von to the gate lines $G_{5a}$ and $G_{5b}$ of the fifth pixel row, thereby turning on the switching elements Qa and Qb connected thereto, respectively. Then, the data voltage for a subpixel PXb is applied to the corresponding subpixel electrodes PEa and PEb.

As described above, in the blank period of the segment TB, if the data voltage for the subpixels PXa is applied to the data lines D1-Dm in advance of a predetermined time period ΔT1 to precharge the data lines D1-Dm with a high voltage before the data voltage for the subpixels PXb to be displayed is applied, the waveform of the data line voltage Vdat applied to the subpixel PXb of the fifth pixel row can be made substantially similar to those of the other pixel rows. The point of time for applying the gate-on voltage Von to the subpixel PXb of the fifth pixel row can be determined by the gate driver 400 in the same manner in which the point of time for applying the gate-on voltage Von to the subpixel PXb of the other pixel rows is determined. Accordingly, the condition for charging the subpixel PXb of the fifth pixel with the data voltage row is made to be equal to the condition for charging the subpixel PXb of the other rows with the data voltage. Hence, horizontal stripes that are easily seen because of a different charging condition can be eliminated.

Such an operation is repeated for one frame. Each of the segments TA, TB, and TC has the same time interval as one horizontal period 1H.

Referring to FIG. 7, an impulsive image of the previous frame is displayed on the initial screen of one frame starting from the top of the screen to about ¼ of the way down the screen ("¼ position"), and a normal image of the previous frame is displayed starting from the ¼ position. In the driving signal of FIG. 5, k equals n/4+1, and thus the longitudinal width of the impulsive image is 25% of the longitudinal width of the entire screen. This ratio indicates the ratio of an impulsive image with respect to an image displayed for one frame in one pixel PX.

A normal image is sequentially displayed according to a scanning start signal STV starting from a first pixel row. An impulsive image is sequentially displayed, starting from an (n/4+1)-th pixel row. After a lapse of a ¼ frame, the normal image is displayed until an n/4-th pixel row, and the impulsive image is displayed starting from a (¼+1)-th pixel row to an n/2-th pixel row. In this way, the impulsive image is displayed while erasing the normal image of the previous frame, and the normal image is displayed while erasing the impulsive image. The impulsive image is displayed like a stripe having a 25% width, and looks like it rotates downward for one frame. By displaying normal images and impulsive images in such a manner, blurring can be prevented. Furthermore, since the increase in frequency for impulsive driving is relatively small, the charging rate of a pixel voltage can be increased.

Although this embodiment has been described with respect to four pixel rows, the present invention is not limited thereto and a certain other number of pixel rows may also be applicable.

A driving method of a liquid crystal display device in accordance with another exemplary embodiment of the present invention will be described in detail with reference to FIGS. 8 and 9.

Figure 8:
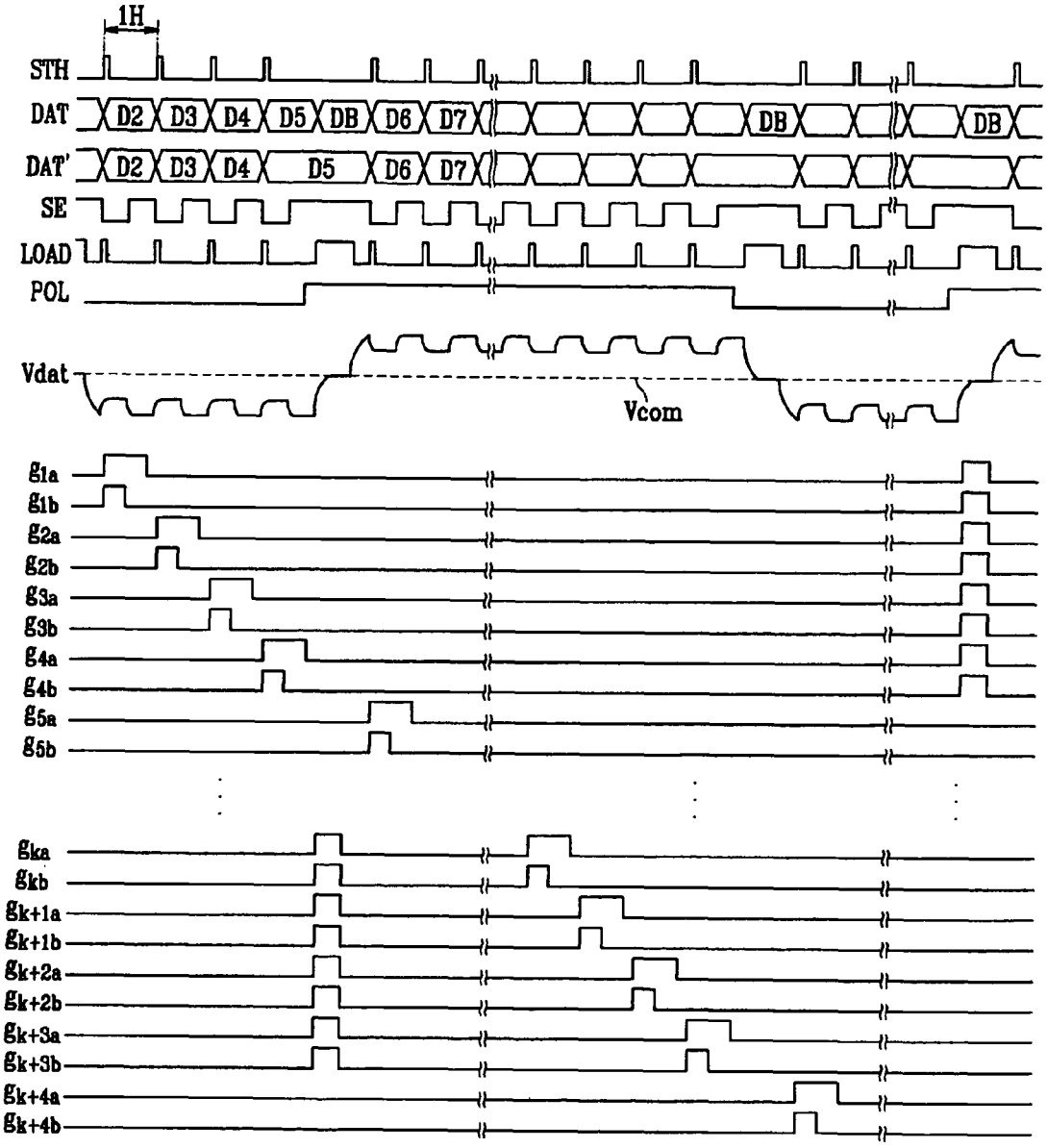
FIG. 8 is a timing diagram illustrating a driving signal of a liquid crystal display device in accordance with another exemplary embodiment of the present invention.
Figure 9:
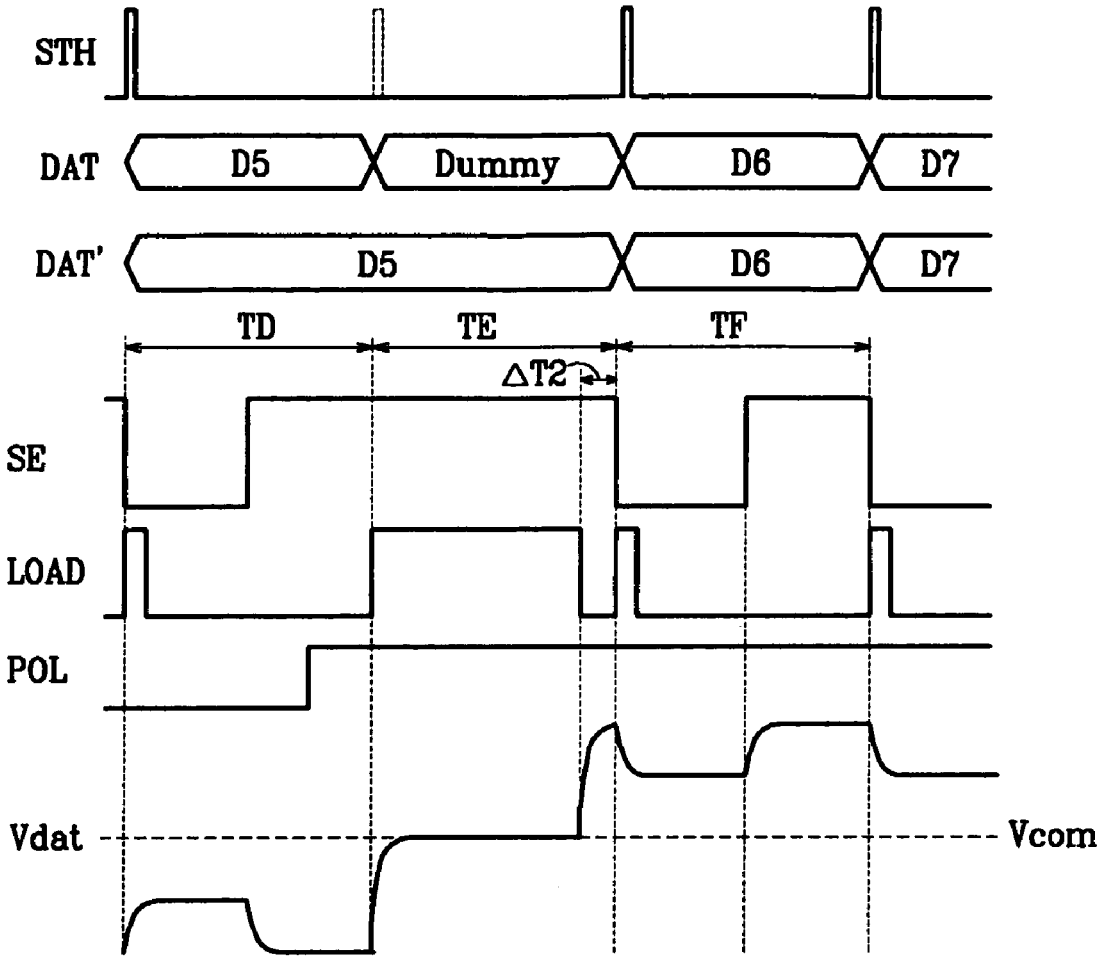
FIG. 9 is an expanded timing diagram illustrating part of the timing diagram of FIG. 8.

FIG. 8 is a timing diagram illustrating a driving signal of a liquid crystal display device in accordance with another exemplary embodiment of the present invention, and FIG. 9 is an expanded timing diagram illustrating part of the timing diagram of FIG. 8.

In this embodiment, M is 4 again. Therefore, a specific explanation will be omitted with respect to the same operations as those of the first embodiment, and only parts that are different from the first embodiment will be explained.

As shown in FIG. 8, the method of charging pixels PX of first to fourth pixel rows with a data voltage is substantially the same as that of the first embodiment.

The primary difference is that the signal controller 600 performs four-row inversion driving by switching the polarity signal POL between a high level and a low level for every four pixel rows in an alternating manner. Accordingly, the polarity of the data voltage flowing through one data line is changed for each four pixel rows. However, the present invention is not limited thereto, and a specific number for row inversion, column inversion, and dot inversion driving may also be applicable.

As shown in FIG. 9, in a segment TD, the signal controller 600 outputs normal image data D5 for pixels PX of the fifth row to the data driver 600 during the charging of a data voltage in the pixels PX of the fourth row. In the segment TD, the signal controller 600 changes the polarity signal POL from a low level to a high level or from a high level to a low level. After completion of transmission of the normal image data D5, the signal controller 600 changes the load signal LOAD to a high level.

Meanwhile, when the level of the polarity signal POL is changed within one horizontal period and the load signal LOAD is changed to a high level, the data driver IC 540 as shown in FIG. 4 (constituting the data driver 500) interconnects all output terminals $Y_1$-$Y_r$ to each other. Once all the output terminals $Y_1$-$Y_r$ are connected, data line voltages Vdat of positive and negative polarities applied to the corresponding data lines are connected to each other. Thus, a charge-sharing voltage substantially having a common voltage Vcom level, is applied to all of the output terminals $Y_1$-$Y_r$. The voltage level Vcom is an intermediate value of the data line voltages Vdat of positive and negative polarities. In this state, when the load signal LOAD is changed again to a low level, the image data DAT stored in the latch 543 is converted into a data voltage and output to the output terminals $Y_1$-$Y_r$.

Accordingly, as shown in FIG. 9, the data line voltages Vdat in the segment TE depend on the charge-sharing voltage. The gate driver 400 simultaneously applies the gate-on voltage Von to the gate lines $G_{ka}$-$G_{k+3b}$ of a (k+3)-rd pixel row starting from a k-th pixel row, thereby turning on the switching elements Qa and Qb connected thereto. Then, the charge-sharing voltage is applied to the corresponding subpixel electrodes PEa and PEb to display an impulsive image.

However, the signal controller 600 does not send a pulse of a horizontal synchronization start signal STH informing of the start of transmission of image data DAT to the data driver 500 even if a new horizontal period, i.e., the segment TE, is started. The pulse indicated by the dotted line in FIG. 9 represents the thus-omitted pulse of the horizontal synchronization start signal STH. Therefore, the data driver 500 does not receive impulsive data DB from the signal controller 600, and the image data DAT' stored in the latch 543 becomes the normal image data D5 that is received in the previous horizontal period. At this time, the transmission of the impulsive data BD to the data driver 500 from the signal controller 600 is optional. Even if the signal controller 600 transmits the impulsive data DB, there is no specific need to generate separate impulsive data DB, and arbitrary dummy data can be transmitted.

In the segment TE, after a lapse of a predetermined length of time, the signal controller 600 changes the load signal LOAD to a low level. Accordingly, the data driver 500 generates a data voltage for the normal image data D5 and applies it to the corresponding data line. At this time, the selection signal SE has to be at a high level, and therefore the data driver 500 refers to a set of (reference) gray voltages for a subpixel PXa.

When a segment TF is started, the signal controller 600 changes the load signal LOAD to a high level and changes the selection signal SE to a low level. Accordingly, the data driver 500 converts the normal image data D5 into a data voltage with reference to the set of (reference) gray voltages for a subpixel PXb and then applies it to the corresponding data line. The gate driver 400 applies the gate-on voltage Von to the gate line $G_{5a}$ and $G_{5b}$ of the fifth pixel row, thereby turning on the switching elements Qa and Qb connected thereto, respectively. Then, the data voltage for the subpixel PXb is applied to the corresponding subpixel electrodes PEa and PEb.

In the segment TE, if the data voltage for the subpixels PXa is applied to the data lines D1-Dm in advance for a predetermined time ΔT2 to precharge the data lines D1-Dm with a high voltage before the data voltage for the subpixels PXb to be displayed is applied, the waveform of the data line voltage Vdat applied to the subpixel PXb of the fifth pixel row is made substantially equal to those of the other pixel rows. Thus, the charging condition is substantially the same and horizontal stripes that are caused by different charging conditions is eliminated. Moreover, the impulsive image can be displayed by using the charge-sharing function of the data driver 500, and the entire segment TE can be used as a blank period by omitting the pulse of the horizontal synchronization start signal STH. As a result, the predetermined time ΔT2 can be sufficiently lengthened, which makes it easier for the charging condition to be the same.

Such an operation is repeated for one frame. Each of the segments TD, TE, and TF has the same time interval as one horizontal period.

The screen displayed by such a driving method is the same as the screen as shown in FIG. 7 for the first embodiment.

Although this embodiment has been described with respect to four pixel rows, the present invention is not limited thereto and a different number of pixel rows may also be applicable.

In summary, according to the present invention, blurring can be prevented by inserting an impulsive image, and horizontal stripes can be prevented by making the charging condition of all of the pixel rows the same.

While this invention has been described in connection with exemplary embodiments, it is to be understood that the invention is not limited to the disclosed embodiments. Rather, the invention is intended to cover various modifications and equivalent arrangements included within the spirit and scope of the appended claims.

What is claimed is:

1. A display device comprising:

a plurality of pixels arranged in a matrix, each of the pixels including a first subpixel and a second subpixel;

a first gate line connected to the first subpixel and transmitting a first gate-on voltage;

a second gate line connected to the second subpixel and transmitting a second gate-on voltage; and a plurality of data lines, wherein the first and second subpixels of the pixel are connected to a same data line which transmits first and second data voltages to the first and second subpixels of the pixel, respectively, wherein the first and second data voltages are obtained from the same image information, the first data voltage is no lower than the second data voltage, and the first data voltage is precharged in a data line before applying the second data voltage to the first subpixel through the data line, and neither the first gate-on voltage nor the second gate-on voltage is transmitted to the first gate line and the second gate line when the data line is precharged with the first data voltage.

2. The display device of claim 1 further comprising a data driver that applies an impulsive data voltage to the data lines before precharging the data lines with the second data voltage.

3. The display device of claim 2, wherein the data driver precharges the first data voltage at least once every two horizontal periods.

4. The display device of claim 2, wherein the data driver starts the precharging of the first data voltage in a blank period of a horizontal period and applies the impulsive data voltage during the blank period.

5. The display device of claim 2 further comprising a conductive material connecting the data lines to each other, wherein the impulsive data voltage is obtained by connecting the data lines to each other.

6. The display device of claim 2, wherein the data driver simultaneously applies the first and second gate-on voltages to the first and second gate lines of multiple pixel rows when the impulsive data voltage is applied to the data lines.

7. The display device of claim 2, wherein a time for applying the first gate-on voltage and a time for applying the second gate-on voltage at least partially overlap.

8. The display device of claim 2, wherein a time for applying the first gate-on voltage is shorter than a time for applying the second gate-on voltage.

9. The display device of claim 1 further comprising:

a gray voltage generator that generates first and second sets of gray voltages that are different from each other; and a data driver selecting gray voltages corresponding to the image information from the first and second sets of gray voltages and applying the gray voltages to the first and second subpixels as the first and second data voltages.

10. The display device of claim 1 further comprising a data driver that sequentially applies the first and second data voltages of a first M number of pixel rows to first and second subpixels of the first M number of pixel rows in an alternating manner, and simultaneously applies an impulsive data voltage to first and second subpixels of a second M number of pixel rows, M being a natural number.

11. The display device of claim 10, wherein the data driver precharges the data lines with the second voltage after applying the impulsive data voltage to the first and second subpixels of the second M number of pixel rows.

12. The display device of claim 1, further comprising:

a gate driver connected to the first and second gate lines and applying the first and second gate-on voltages thereto;

a data driver connected to the data lines and applying the first and second data voltages and the impulsive data voltage thereto; and a signal controller for controlling the data driver and the gate driver.

13. The display device of claim 12, wherein the data driver starts to precharge the first data voltage in the data lines within one horizontal period from the point of time when the impulsive data voltage is applied.

14. The display device of claim 12, wherein the signal controller transmits the pulse of a horizontal synchronization start signal to the data driver every horizontal period, and the pulse of the horizontal synchronization start signal is omitted every predetermined number of horizontal periods.

15. The display device of claim 14, wherein the signal controller omits the pulse of the horizontal synchronization start signal after changing the voltage level of a polarity signal.

16. The display device of claim 14, wherein the data driver has a plurality of output terminals connected to the data lines, and connects the output terminals to each other in the horizontal period in which the pulse of the horizontal synchronization start signal is omitted.

17. A driving method of a display device, which comprises a plurality of pixels each including first and second subpixels, a first and second gate line connected to the first and second subpixels, respectively, and a plurality of data lines, wherein the first and second subpixels of the pixel are connected to a same data line which transmits first and second data voltages to the first and second subpixels of the pixel, respectively, comprising:

precharging the same data line with the first data voltage;

applying the second data voltage to the second subpixel after the precharging of the same data line; and applying the first data voltage to the first subpixel after applying the second data voltage, and neither the first gate-on voltage nor the second gate-on voltage is transmitted to the first gate line and the second gate line when the data line is precharged with the first data voltage.

18. The method of claim 17, further comprising applying an impulsive data voltage to the first and second subpixels before the precharging of the data lines.

19. The method of claim 18, wherein the applying of the impulsive data voltage comprises connecting the data lines to each other.

20. The method of claim 18, wherein the applying of the impulsive data voltage comprises simultaneously applying the impulsive data voltage to first and second subpixels of a plurality of pixel rows.

21. The method of claim 17, wherein the applying of the first data voltage comprises applying a first gate-on voltage to the first gate line and applying a gate-off voltage to the second gate line, and the applying of the second data voltage comprises applying a second gate-on voltage to the second gate line and applying the first gate-on voltage to the first gate line.

22. The method of claim 21, wherein the times for applying the first and second gate-on voltages in the applying of the second data voltage are at least partially overlapped.

23. The method of claim 17, wherein the charging of the data lines is carried out at least every two horizontal periods.

24. The method of claim 17, further comprising:

generating first and second sets of gray voltages that are different from each other;

selecting either the first set of gray voltages or the second set of gray voltages; and generating a first data voltage with reference to the first set of gray voltages when the first set of gray voltages is selected, and generating a second data voltage with reference to the second set of gray voltages when the second set of gray voltages is selected.

* * * * *